US006179175B1

(12) United States Patent
Painter

(10) Patent No.: US 6,179,175 B1
(45) Date of Patent: Jan. 30, 2001

(54) CHILD'S KNAPSACK HARNESS AND METHOD OF USE THEREFOR

(76) Inventor: Brita L. Painter, 21 Commercial Blvd., Suite 14, Novato, CA (US) 94949

( * ) Notice: Under 35 U.S.C. 154(b), the term of this patent shall be extended for 0 days.

(21) Appl. No.: 09/347,246

(22) Filed: Jul. 2, 1999

(51) Int. Cl.[7] ..... A45F 4/02

(52) U.S. Cl. ..... 224/153; 224/257; 224/262; 224/627; 224/637

(58) Field of Search ..... 224/153, 16, 640, 224/646, 647, 648, 649, 660, 639, 637, 627, 625, 626, 259, 262; D3/216, 217

(56) References Cited

U.S. PATENT DOCUMENTS

| | | | |
|---|---|---|---|
| 3,938,718 | | 2/1976 | Madison . |
| 4,082,208 | | 4/1978 | Lane, Jr. . |
| 4,327,852 | | 5/1982 | Gibson . |
| 4,491,258 | | 1/1985 | Jones . |
| 4,662,549 | | 5/1987 | Dean . |
| 4,793,534 | | 12/1988 | Berry . |
| 4,809,896 | | 3/1989 | McColly . |
| 4,848,624 | | 7/1989 | Clem . |
| 4,884,731 | | 12/1989 | Sibley . |
| 4,923,105 | | 5/1990 | Snyder . |
| 4,925,070 | | 5/1990 | Tulan . |
| 4,936,495 | | 6/1990 | Van de Pol . |
| 5,005,744 | | 4/1991 | Gleason . |
| 5,016,797 | * | 5/1991 | Rowledge ..... 224/639 X |
| 5,060,835 | | 10/1991 | Payne . |
| 5,114,059 | | 5/1992 | Thatcher . |
| 5,147,079 | | 9/1992 | Heather . |
| 5,184,763 | | 2/1993 | Blaisdell et al. . |
| 5,240,157 | | 8/1993 | Selhost . |
| 5,240,159 | | 8/1993 | Gregory . |
| 5,284,279 | | 2/1994 | Sason et al. . |
| 5,341,974 | | 8/1994 | Robinson et al. . |
| 5,361,951 | | 11/1994 | Chehebar . |
| 5,361,955 | | 11/1994 | Gregory . |
| 5,415,332 | | 5/1995 | Kliot . |
| 5,431,317 | | 7/1995 | Kliot . |
| 5,445,303 | | 8/1995 | Cawile, Jr. . |
| 5,449,102 | | 9/1995 | Sason . |
| 5,465,886 | | 11/1995 | Scherer . |
| 5,540,364 | | 7/1996 | Krieger et al. . |
| 5,562,236 | | 10/1996 | Monzingo . |
| 5,570,824 | | 11/1996 | Lyon et al. . |
| 5,586,699 | | 12/1996 | Heisler et al. . |
| 5,586,705 | | 12/1996 | Leonard . |
| 5,603,441 | | 2/1997 | Easter . |
| 5,628,443 | | 5/1997 | Deutsch . |
| 5,630,536 | | 5/1997 | Bugnaski . |
| 5,639,005 | | 6/1997 | Chouinard . |
| 5,673,836 | | 10/1997 | Bush . |
| 5,704,530 | | 1/1998 | Scherer . |
| 5,725,139 | | 3/1998 | Smith . |
| 5,727,720 | | 3/1998 | Thatcher . |
| 5,730,340 | | 3/1998 | Bosic . |
| 5,765,733 | | 6/1998 | Brule . |
| 5,775,558 | | 7/1998 | Montalbano . |
| 5,799,851 | | 9/1998 | Wulf et al. . |
| 5,806,740 | | 9/1998 | Carlson . |
| 5,961,014 | * | 10/1999 | Knerr ..... 224/153 X |

OTHER PUBLICATIONS

Portion of Kelty 1998 Catalog, p. 21.

Stearns Inc. product brochure "Stearns Introduces . . . Its New Line of Lego Outdoor Children's Products", 1998, 1 page.

Portions of JanSport 1998 Catalog, 3 pages.

Portion of Camptrails 1995 Catalog, 3 pages.

* cited by examiner

*Primary Examiner*—Gregory M. Vidovich
*Assistant Examiner*—Maerena W. Brevard
(74) *Attorney, Agent, or Firm*—Limbach & Limbach LLP

(57) ABSTRACT

A modular child's harness and knapsack is disclosed having a waist belt, two shoulder straps, and gear that attaches to the waist belt and shoulder straps. The lower ends of the shoulder straps are foldable so that they may be folded up for use by a smaller child, and later unfolded as the child grows taller.

14 Claims, 10 Drawing Sheets

CHILD'S KNAPSACK HARNESS AND METHOD OF USE THEREFOR

BACKGROUND OF THE INVENTION

1. Field of the Invention

The present invention relates generally to a knapsack harness, and more particularly to a modular child's harness with adjustment features that allow the harness to be continued to be used as a child grows.

2. Discussion of the Prior Art

Many different types of backpacks, daypacks, knapsacks, bookbags, and waistpacks exist for camping, hiking, sports, recreation, travel, and other needs. Most are specifically designed for adults, and some are designed for children. Although prior art packs for children typically have adjustments to allow them to fit a range of children, they are optimized for a particular size child and designed for a specific activity. One pack may be appropriate for camping, another for picnicking, another for hiking, another for school and sports, etc. This requires that several packs be purchased for a child, and as the child grows, larger equipment must be purchased.

What is needed and not provided by the prior art is a simple child's pack that can grow with the child, and be adapted for many different uses over the course of many years.

SUMMARY OF THE INVENTION

The present invention is a modular pack system that can be configured for many different uses, and can expand as a child grows larger and participates in more activities.

In its simplest form, a pack system constructed according to the present invention starts with a simple waist belt and a clip attached to a loop for sliding onto the belt. The clip can be used to attach a favorite toy or other object to the child's belt. The belt is adjustable and releases with a plastic buckle.

Other small items can be attached to the belt, such as a water bottle pouch (first small capacity, then large.) A small pouch can later be added to the belt to hold a snack, sunglasses or other small items. A larger pouch can be added by itself or in conjunction with the previous items to hold such things as a camera or jacket.

To the same waist belt a pair of shoulder straps can be added to provide the next modular platform. In the preferred embodiment plastic loops are arranged along the outside of the back of the shoulder straps for attaching gear such as a ground cloth, sleeping pad, sleeping bag, bag for food & clothes, fishing pole, tent, etc. These items can be added one by one to the shoulder strap and waist belt combination as the child is able to carry more. In this way a child can begin to participate at an early age in an activity such as backpacking. As the child progresses, new components can be added and/or subtracted without having to purchase the entire pack at the outset or having to repurchase entirely new gear at every stage of development.

In accordance with one aspect of the present invention, the disclosed pack system is modular as described above.

In accordance with another aspect of the invention, the rearward lower ends of the shoulder straps are provided with a hingable section adjacent to where the shoulder straps slidably attach to the waist belt. The end portion is initially folded up and secured in a retracted, J-shaped position when the child is small. After the child has grown, the end portion is released and extended, thereby expanding the distance between the waist belt and the attachment points on the shoulder straps. This allows the same harness to be used and fit properly over the course of many more years.

In accordance with still another aspect of the invention, a pack bag is provided that may be alternately carried by a handle, a single shoulder strap, or attached to the knapsack harness system.

In accordance with yet another aspect of the invention, the rigidity of the knapsack is provided mainly by the attached gear rather than by the shoulder straps, waist belt, or a frame. This allows the knapsack to be extremely lightweight, a feature particularly important for smaller children.

DETAILED DESCRIPTION OF THE PREFERRED EMBODIMENT

Figure 1:
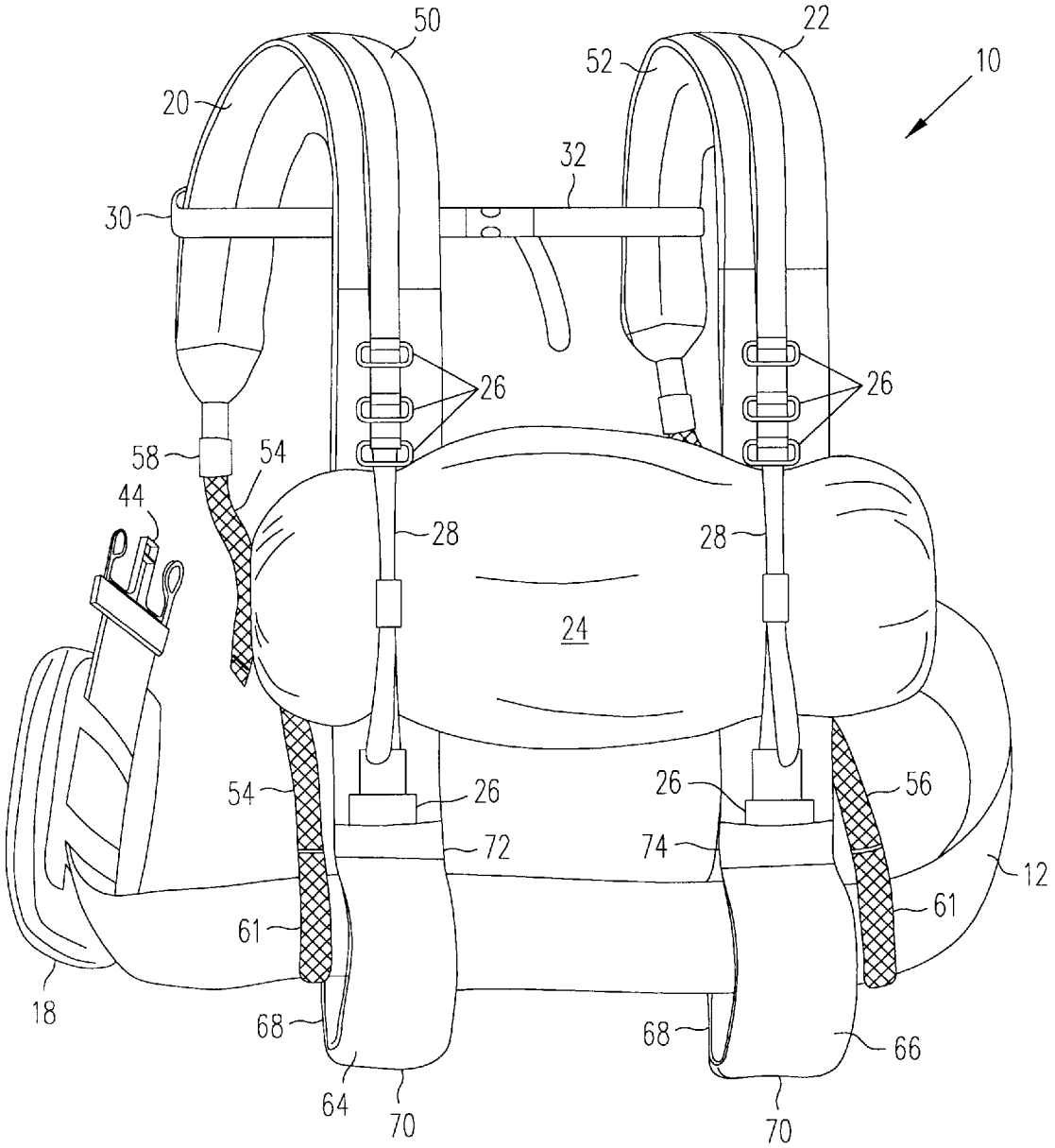
FIG. 1 is a rear perspective view showing a pack apparatus constructed according to the present invention for a small child and having a sleeping bag and snack pouch.
Figure 4B:
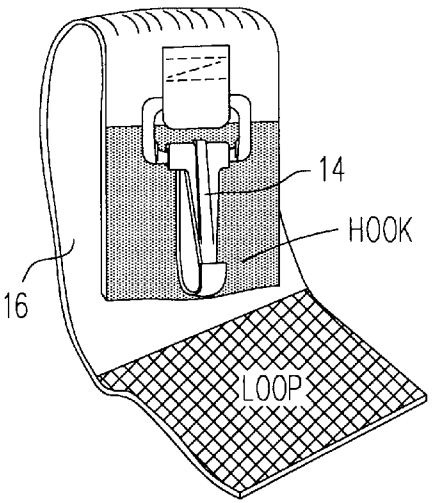
FIG. 4B is a perspective view showing a clasp for attaching to the waist belt.
Figure 4A:
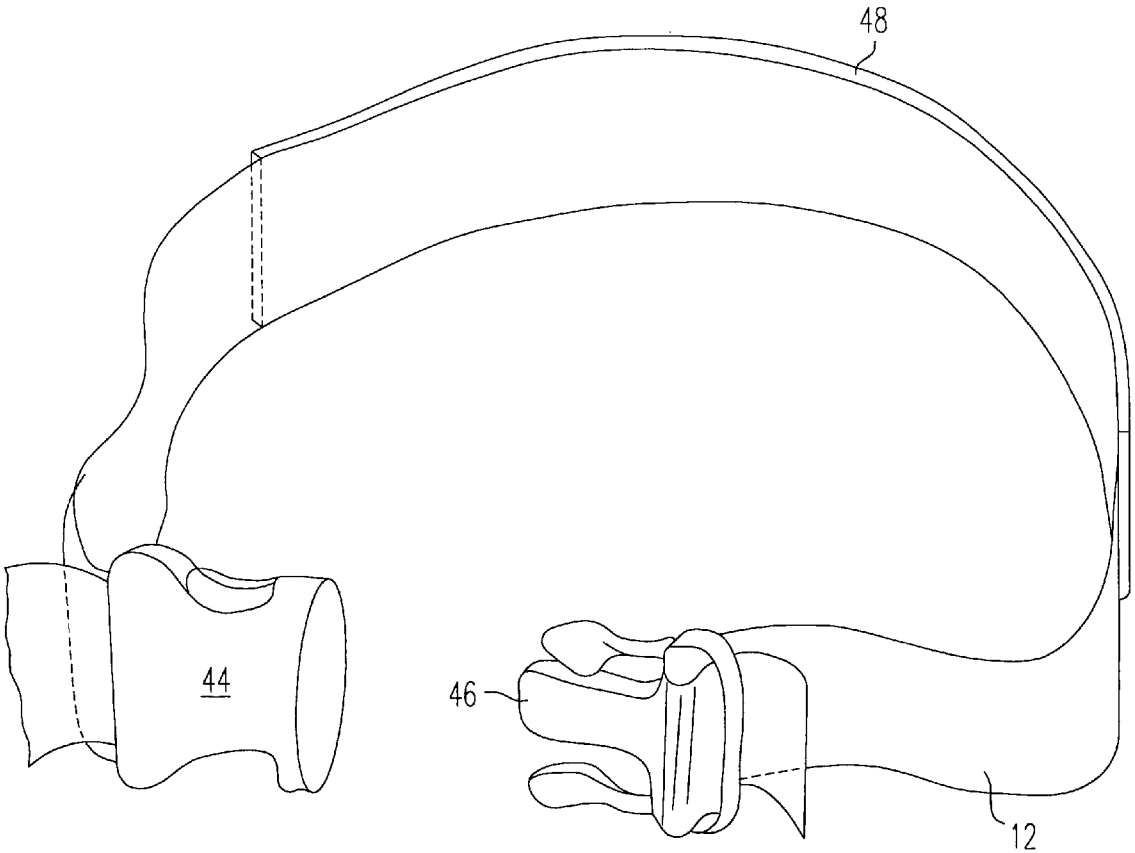
FIG. 4A is a front perspective view showing a waist belt.

Referring to FIG. 1, a pack system 10 constructed according to the preferred embodiment of the present invention is shown. Pack system 10 is highly modular, and can be assembled in a variety of configurations. The simplest configuration for a small child starts with a waist belt 12, shown by itself in FIG. 4A. Single item, can be added to waist belt 12 using clip 14 which is attached to belt 12 with hook and loop type fastener 16, as shown in FIG. 4B. As shown in FIG. 1, items such as a snack pouch 18 can be attached by sliding over belt 12.

When the child has grown some, shoulder straps 20 and 22 can be added to belt 12 to allow more gear, such as sleeping bag 24, to be attached to the modular harness system. Shoulder straps 20 and 22 include attachment loops 26 so that straps 28 can be used to attach a variety of gear to shoulder straps 20 and 22. Preferably, attachment loops 26 are provided every 2 inches so that attached items can be adjusted (raised or lowered) or re-positioned for best fit and most comfort. Attaching gear to shoulder straps 20 and 22 provides rigidity to pack 10, as there is no frame or pack bag built in. Releasable chest straps 30 and 32 span across the front of shoulder straps 20 and 22 to provide further positioning thereof. Chest straps 30 and 32 are slidable along shoulder straps 20 and 22.

Figure 2:
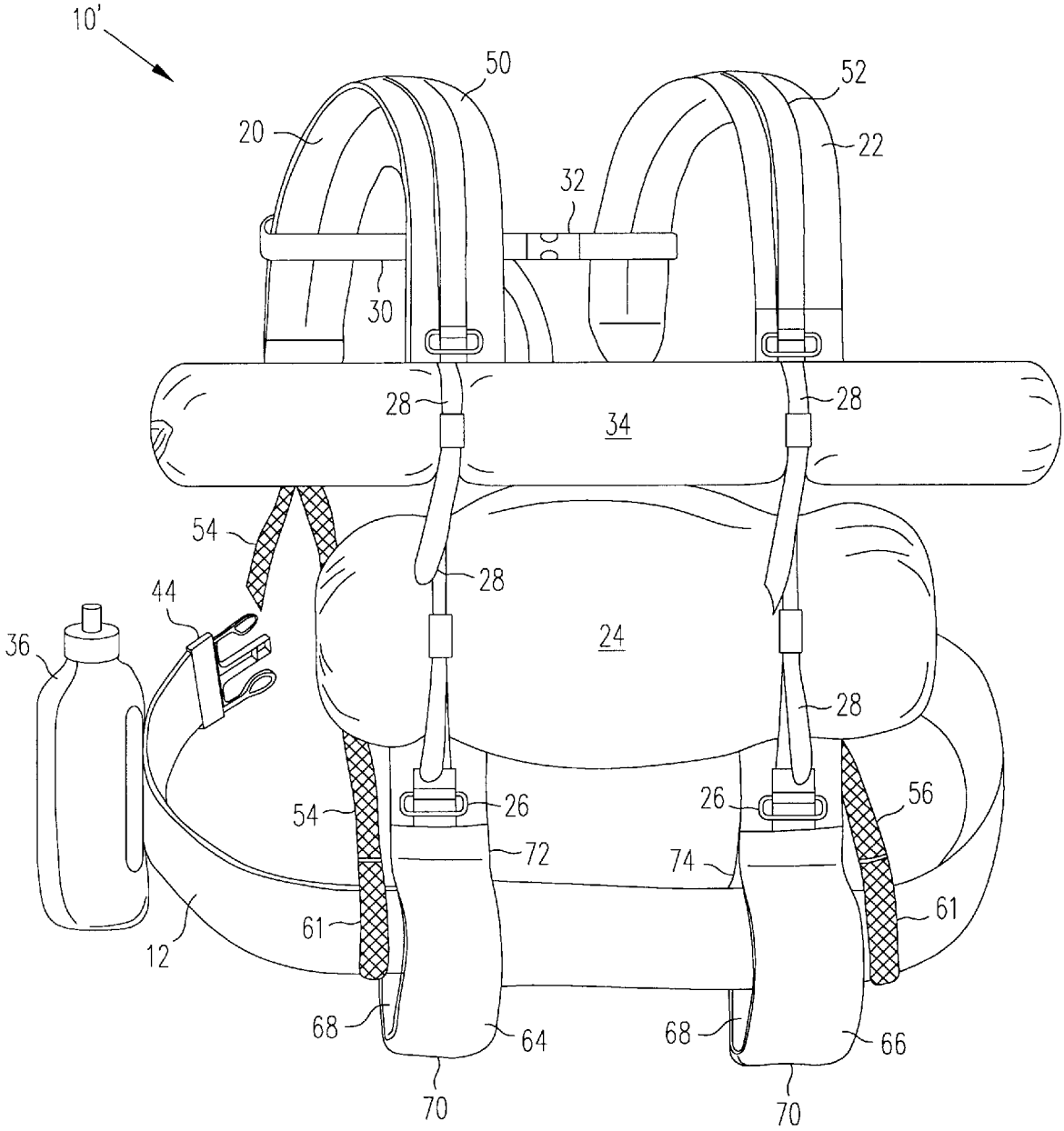
FIG. 2 is a rear perspective view similar to FIG. 1 for a small child and having a sleeping bag, pad and water bottle.

Referring to FIG. 2, a larger pack 10' can be configured by adding sleeping pad 34 to shoulder straps 20 and 22, and adding water bottle 36 to waist belt 12.

Figure 3:
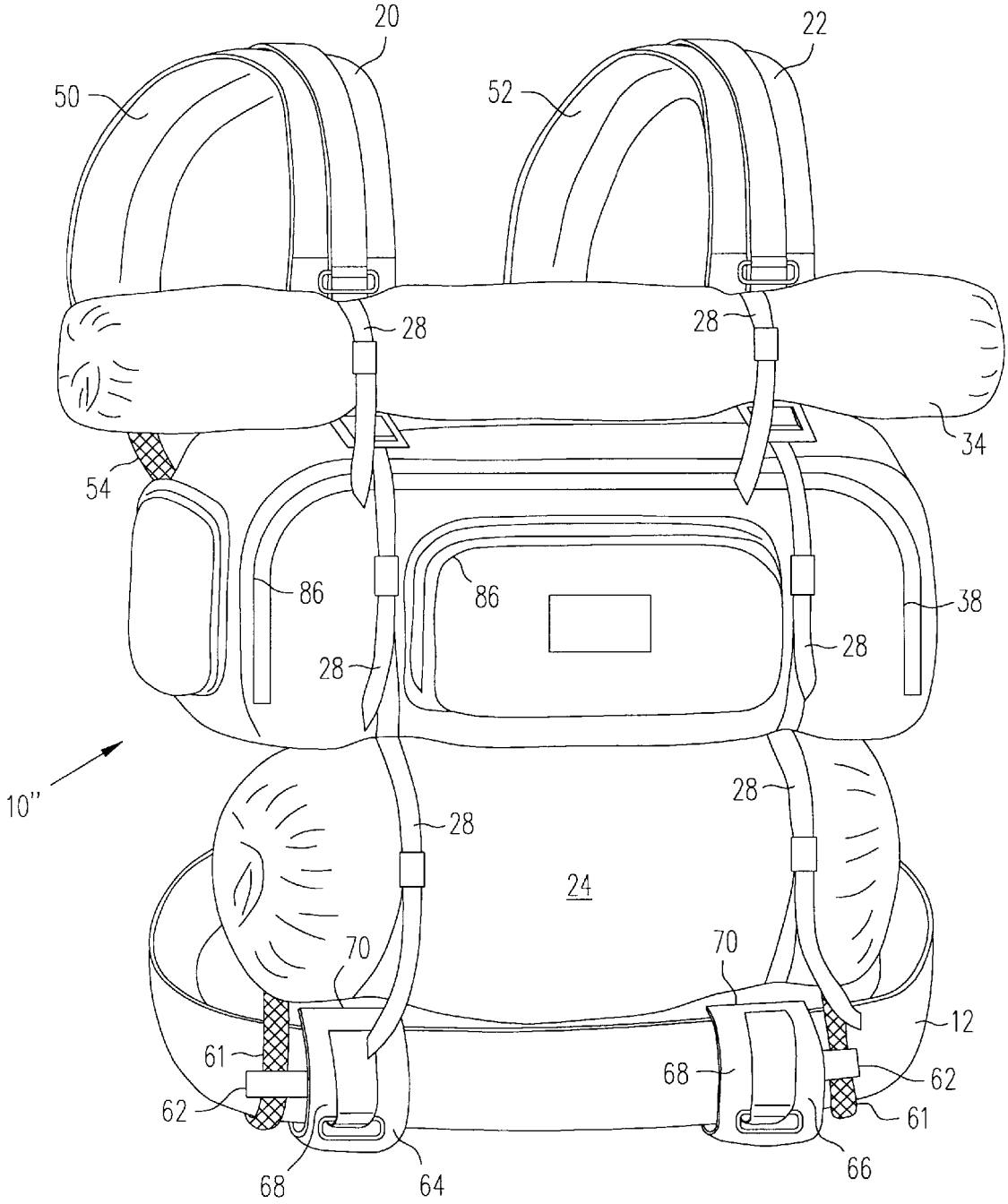
FIG. 3 is a rear perspective view similar to FIG. 1 for a large child and having a backpack bag, sleeping bag and pad.

Referring to FIG. 3, an even larger pack 10" can be configured by adding pack. bag 38. Pack bag 38 has two upper attachment fittings 40 (shown in FIG. 6B) and two lower releasible cl ps 42 (shown in FIG. 8) that mate with attachment loops 26 and adjacent webbing 60, respectively, to attach bag 38 to shoulder straps 20 and 22. In the configuration shown in FIG. 3, shoulder straps 20 and 22 are lengthened for a larger child by unfolding and extending the lower portions of shoulder straps 20 and 22, as will be more fully described below. In all of the configurations, it is preferable to locate the heaviest items as low as possible on shoulder straps 20 and 22.

Referring again to FIG. 4A, waist belt 12 is shown. Mating halves 44 and 46 of a plastic buckle are provided on opposite ends of waist belt 12 to allow belt 12 to be releasible and fully adjustable over a wide range of children's waist sizes. Preferably, a second layer of webbing 48 is sewn to waist belt 12 in the rear region thereof to provide extra rigidity there.

Figure 5A:
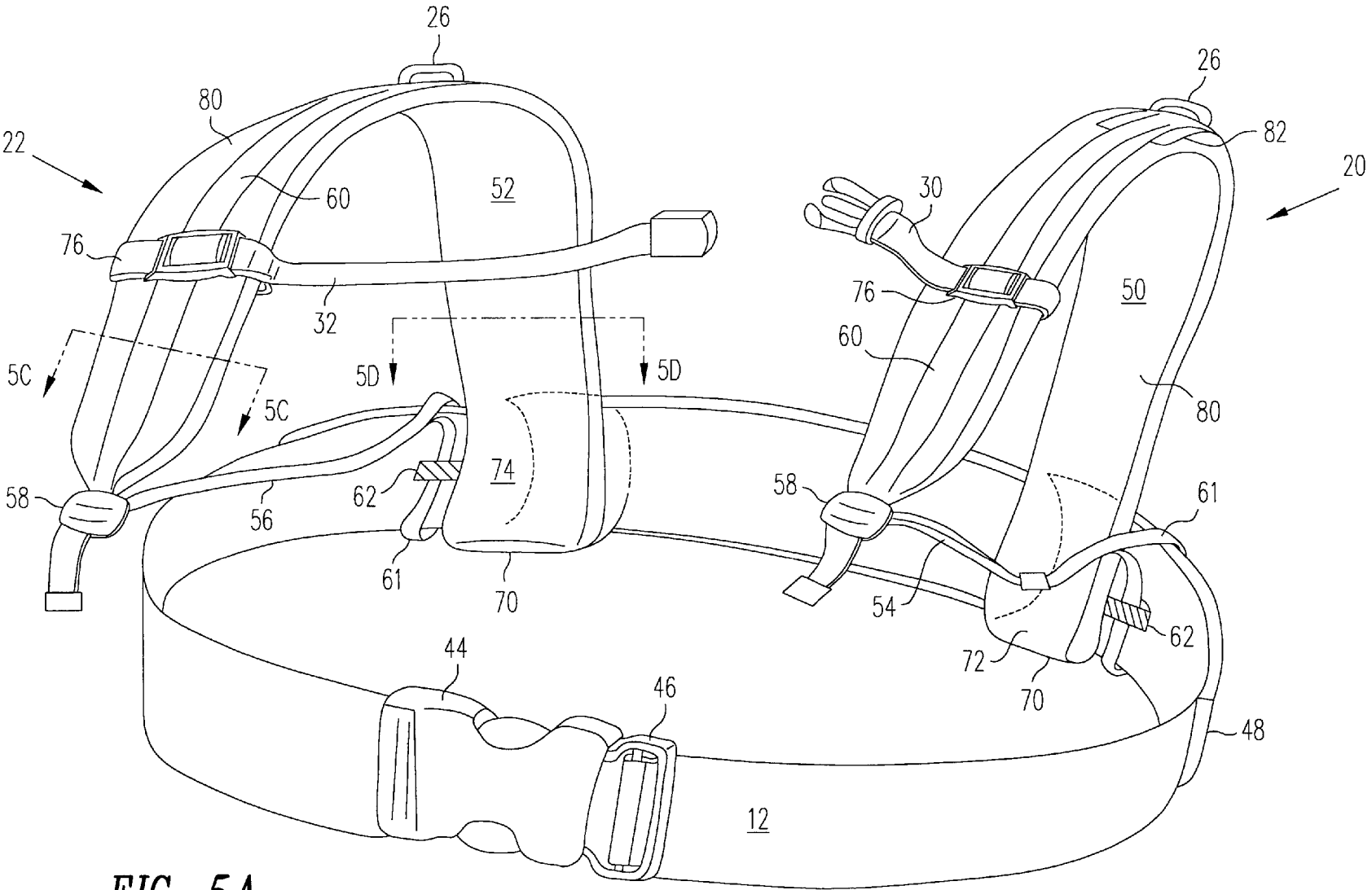
FIG. 5A is an upper front perspective view showing a pack harness constructed according to the present invention.
Figure 6B:
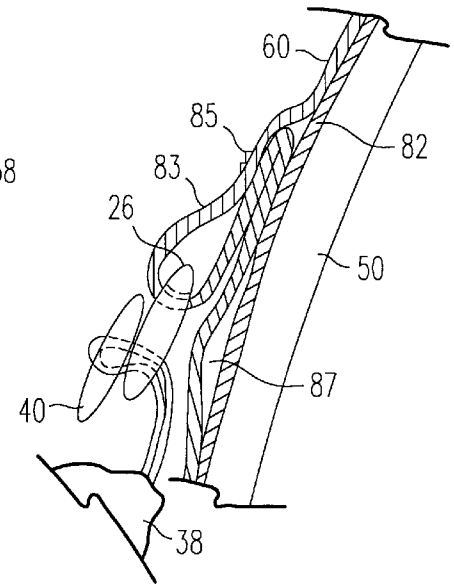
FIG. 6B is an enlarged fragmentary view showing the detail of an attachment loop connection.
Figure 6A:
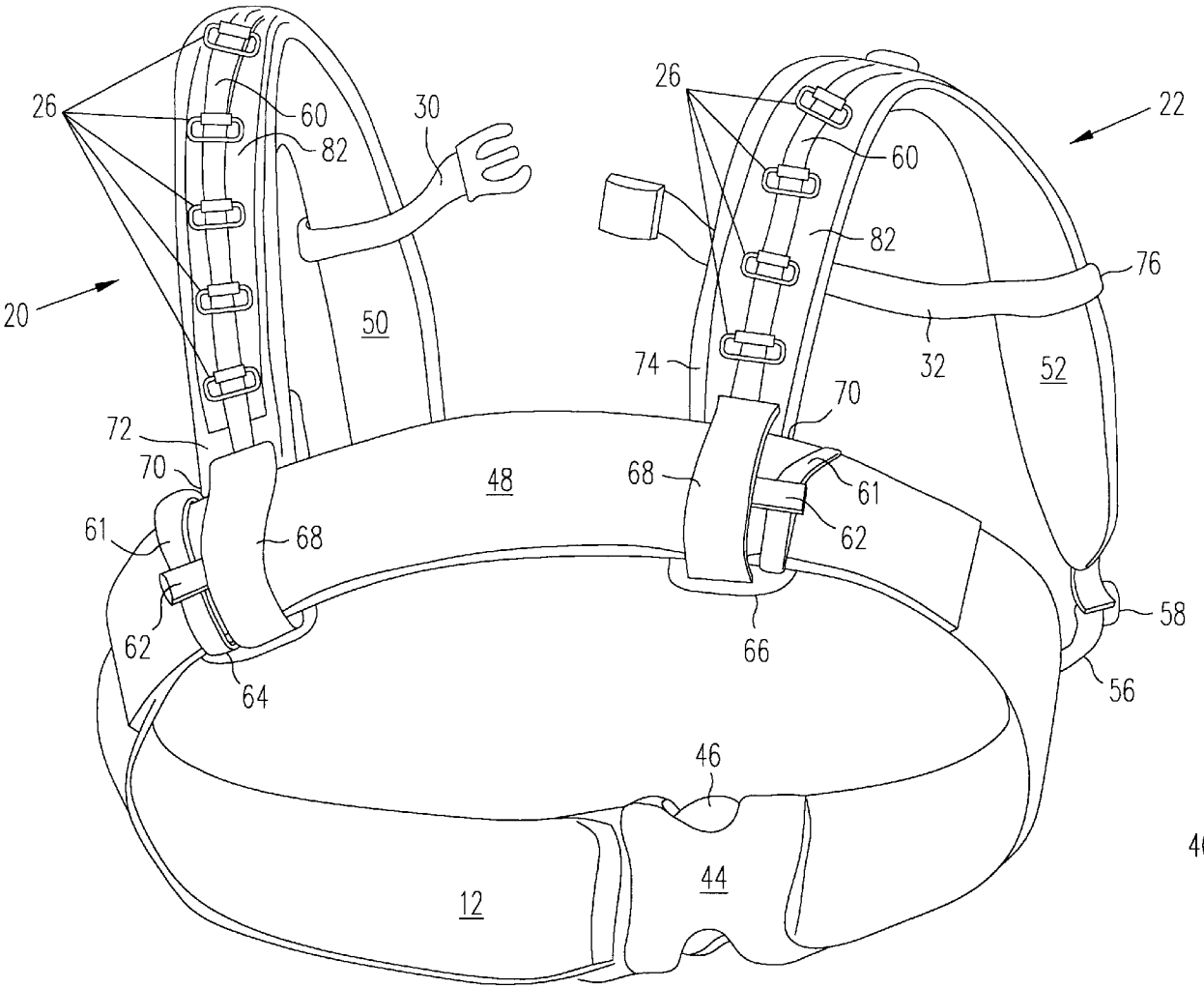
FIG. 6A is a lower rear perspective view showing a pack harness constructed according to the present invention.

Referring to FIGS. 5A and 6A, detailed views of the harness are shown. Shoulder straps 20' and 22" each include a main padded portion 50 and 52, respectively, and a lower connecting portion 54 and 56, respectively. The upper ends of connecting portion 54 and 56 are adjustably connected to main padded portions 50 and 52 by plastic buckles 58. Buckles 58 are permanently attached to webbing 60, which runs along the outer length of padded portions 50 and 52 and secures attachment loops 26 thereto.

The lower ends of connecting portions 54 and 56 have loops 61 that are permanently connected to fabric loops 62, which in turn are sewn into the bottom portions of main padded portions 50 and 52. Preferably, loops 61 slidably receive waist belt 12 and are maintained just to the outside of waist belt loops 68 by fabric loops 62.

The lower ends 64 and 66 of main padded portions 50 and 52, respectively, are provided with waist belt loops 68 for slidably receiving waist belt 12. Although not required, hook and loop type fastening elements (not shown) can be employed within loops 68 and/or on waist belt 12 to prevent the lower ends 64 and 66 of shoulder straps 20 and 22 from sliding once properly positioned on waist belt 12.

Hinge portions 70 are provided horizontally across main padded portions 50 and 52 just above waist belt loops 68. Hinge portions 70 are preferably created by removing padding along this line or compressing the padding with stitching. Hinge portions 70 allow lower ends 64 and 66 to be folded up against adjacent portions 72 and 74, respectively, to shorten main padded portions 50 and 52, as will be further described below.

Figure 5B:
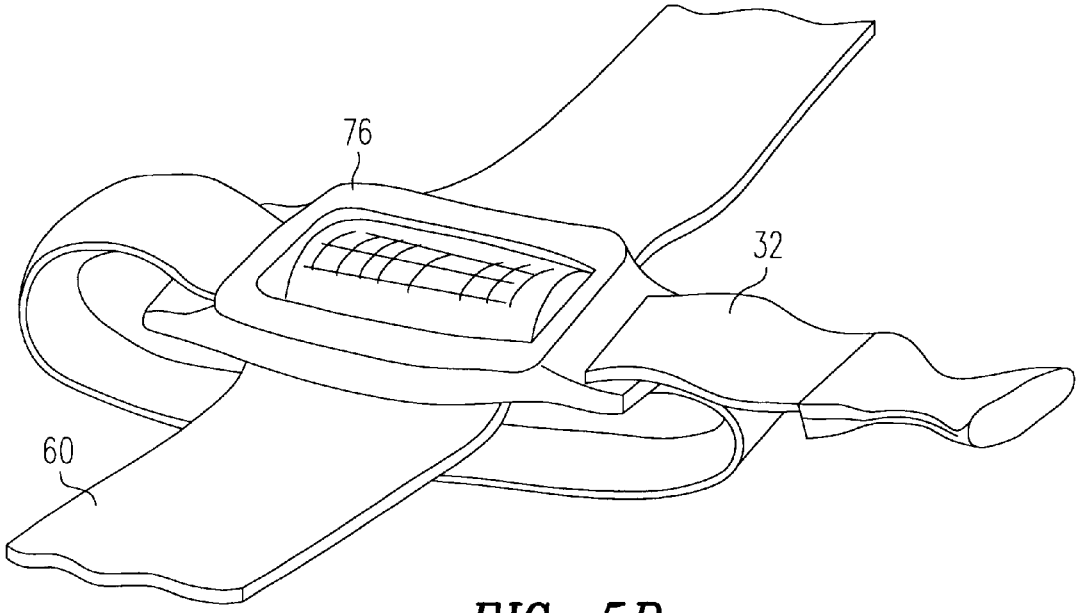
FIG. 5B is an enlarged fragmentary view showing the detail of a chest strap connection.

Referring to FIG. 5B, a detailed view of the connection between chest strap 32 and shoulder strap 22 is shown (main padded portion 52 of shoulder strap 22 is removed for clarity.) Cross buckle 76 is slidably captivated by shoulder strap webbing 60. Chest strap 32 is wrapped around main padded portion 52, stitched to itself to form a loop therearound, and is also slidably captivated by cross buckle 76 at a right angle to webbing 60. Chest strap 32 may slide up and down main padded portion 52 for adjustment when being worn, but is prevented from sliding too easily by the friction therebetween. Opposite chest strap 30 is connected to shoulder strap 20 in a similar fashion.

Figure 5C:
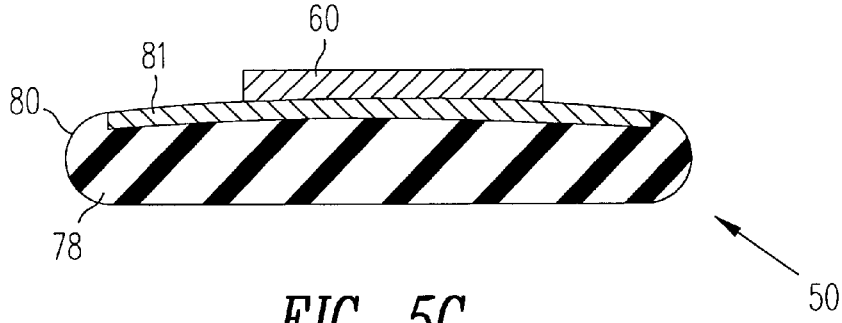
FIG. 5C is a cross-sectional view taken along line 5C—5C in FIG. 5A.

Referring to FIG. 5C, a cross-section of the front of main padded portion 52 is shown, taken along line 5C—5C in FIG. 5A. Preferably, main padded portion 52 is constructed by surrounding closed cell foam padding 78 with fabric 80, such as nylon. Preferably a layer of heavy nylon webbing ("scuba webbing") 81 is located between padding 78 and fabric tube 80 to provide more structure and durability to padded portion 52. Webbing 60 is attached to the outside by stitching through both sides of main padded portion 52. The front of main padded portion 50 is constructed in the same manner.

Figure 5D:
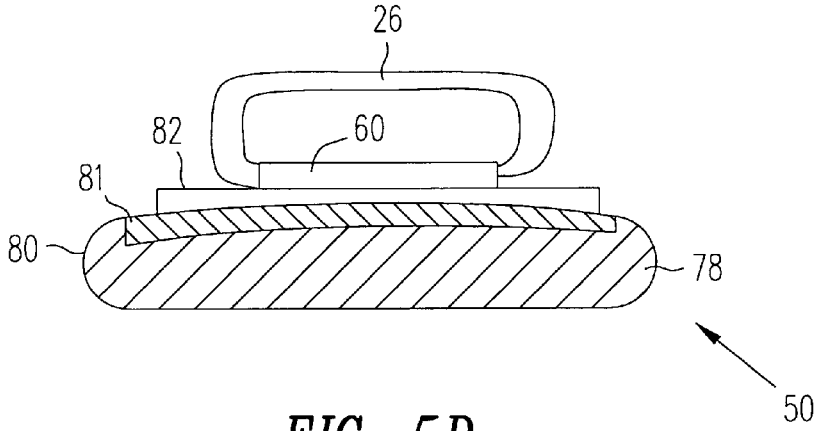
FIG. 5D is a cross-sectional view taken along line 5D—5D in FIG. 5A.

Referring to FIG. 5D, a cross-section of the rear of main padded portion 52 is shown, taken along line 5D—5D in FIG. 5A. Preferably, an extra layer of webbing 82 is provided between webbing 60 and fabric 82, having a width in between that of webbing 60 and main padded portion 52. The extra layer of fabric 82 provides a more solid and stronger surface on the rear of shoulder straps 20 and 22 where attachment loops 26 are connected. The rear of main padded portion 50 is constructed in the same manner.

Referring to FIG. 6B, attachment loops 26 are connected to main padded portions 50 and 52 by loops 83 formed in webbing 60 and secured by stitching 85. Because of the orientation of loops 83, an excessive load is not put on stitching 85 from the weight of the attached gear, making for a strong attachment point for the gear. Lower clips 42 on bag 38 can attach to webbing 60 at loops 83 or in between the stitching of adjacent loops 83 through gaps 87.

Figure 7B:
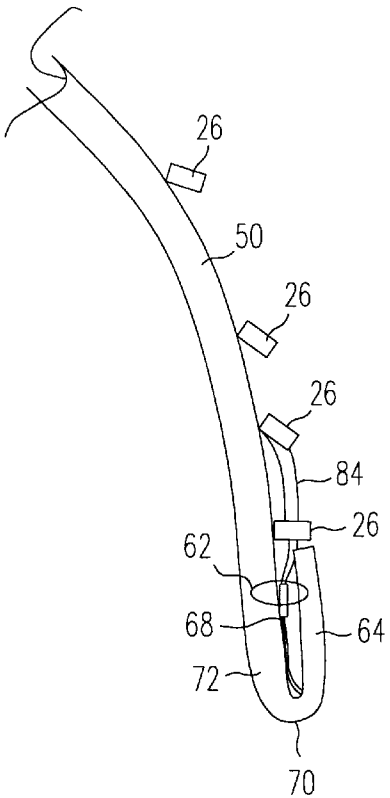
FIG. 7B is a fragmentary side elevation view showing a shoulder strap with its proximal end portion in a retracted position.
Figure 7A:
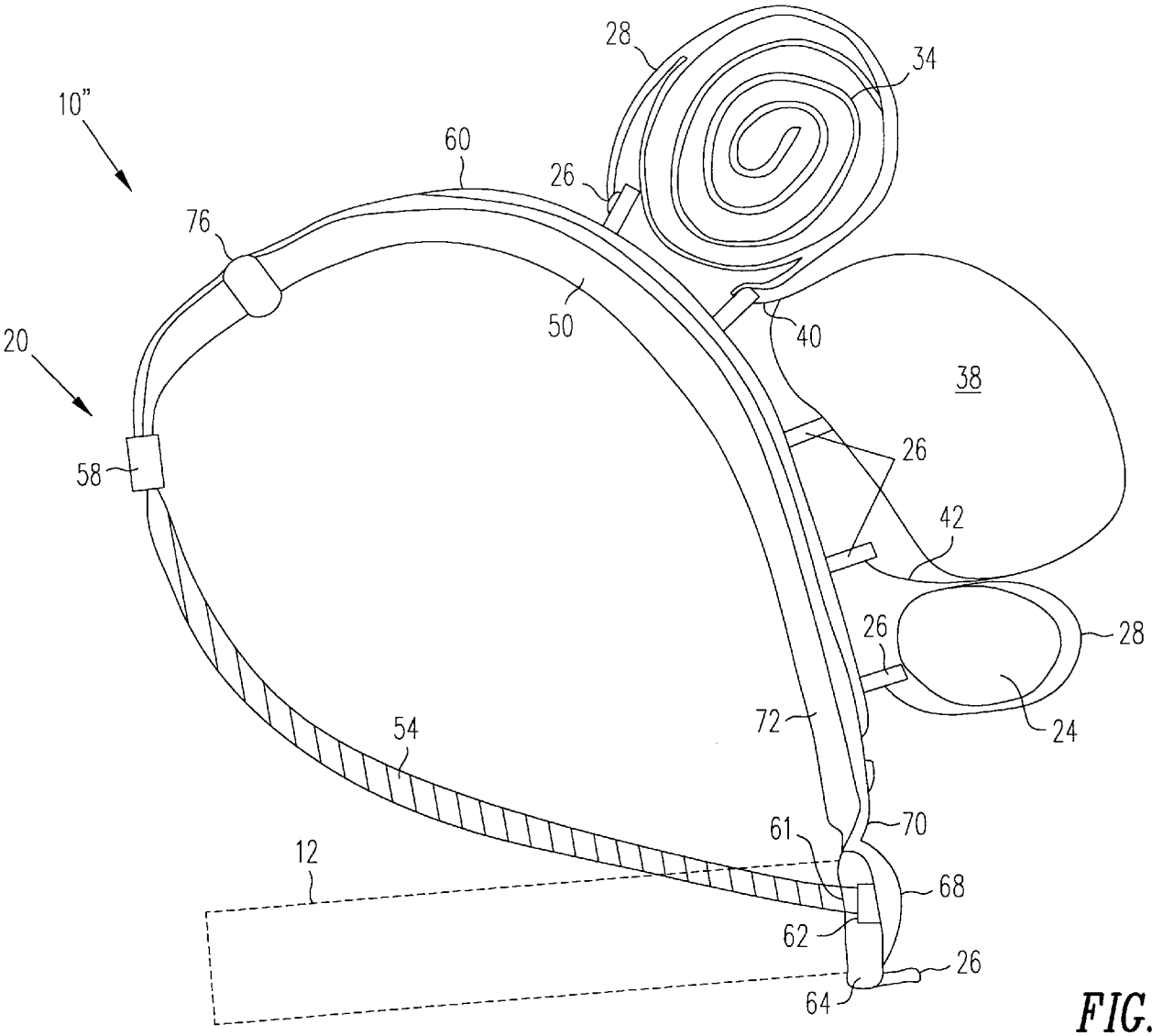
FIG. 7A is a side elevation view showing a pack harness constructed according to the present invention.

Referring to FIGS. 7A and 7B, the folding feature of shoulder straps 20 and 22 will be described (for simplicity, only shoulder strap 20 is shown and described, although shoulder strap 22 is constructed and functions in the same manner.) As previously described above, a hinged portion 70 is provided between the lower end 64 of shoulder strap 20 and adjacent portion 72. Hinged portion 70 allows lower end 64 to be folded up from the extended position shown in FIG. 7A to a retracted position as shown in FIG. 7B. In the retracted position, lower end 64 preferably lies flat against the outside of adjacent portion 72. Lower end 64 has an attachment loop 26 that can be fastened to an adjacent attachment loop 26 with a short fastening strap 84 to hold lower end 64 in the retracted position against adjacent portion 72. Fastening strap is preferably made of hook and loop type fastening material.

The inventive pack harness system is initially used for a small child with the lower ends 64 in the retracted position shown in FIG. 7B and the lower connecting portions 54 and 56 of shoulder straps 20 and 22 tightened up at buckles 58. As the child grows, connecting portions 54 and 56 are gradually loosened at buckles 58 to make shoulder straps 20 and 22 longer. Eventually, fastening straps 84 are released and the lower ends 64 and 66 of shoulder straps 20 and 22 are extended into the non-retracted position shown in FIG. 7A to fit the larger child. At this time, waist belt 12 can be rotated with respect to waist belt loops 68 so that waist belt buckle member 44 and 46 remain in the proper orientation. It will be noted that the same amount of padding exists between waist belt 12 and the child regardless of whether lower ends 64 and 66 are in the retracted or non-retracted positions.

In the preferred embodiment, two different size harnesses are used to cover the range of children between toddler and teenager. With the smaller harness, the main padded portions 50 and 52 of the shoulder straps 20 and 22 are approximately 24.5 inches long, and with the larger harness they are approximately 32.5 inches long. The lower ends 64 and 66 of both harnesses are approximately 3.5 inches long. The padded portions 50 and 52 of both harnesses are about 2.25 inches wide and 0.63 inches thick.

Figure 8:
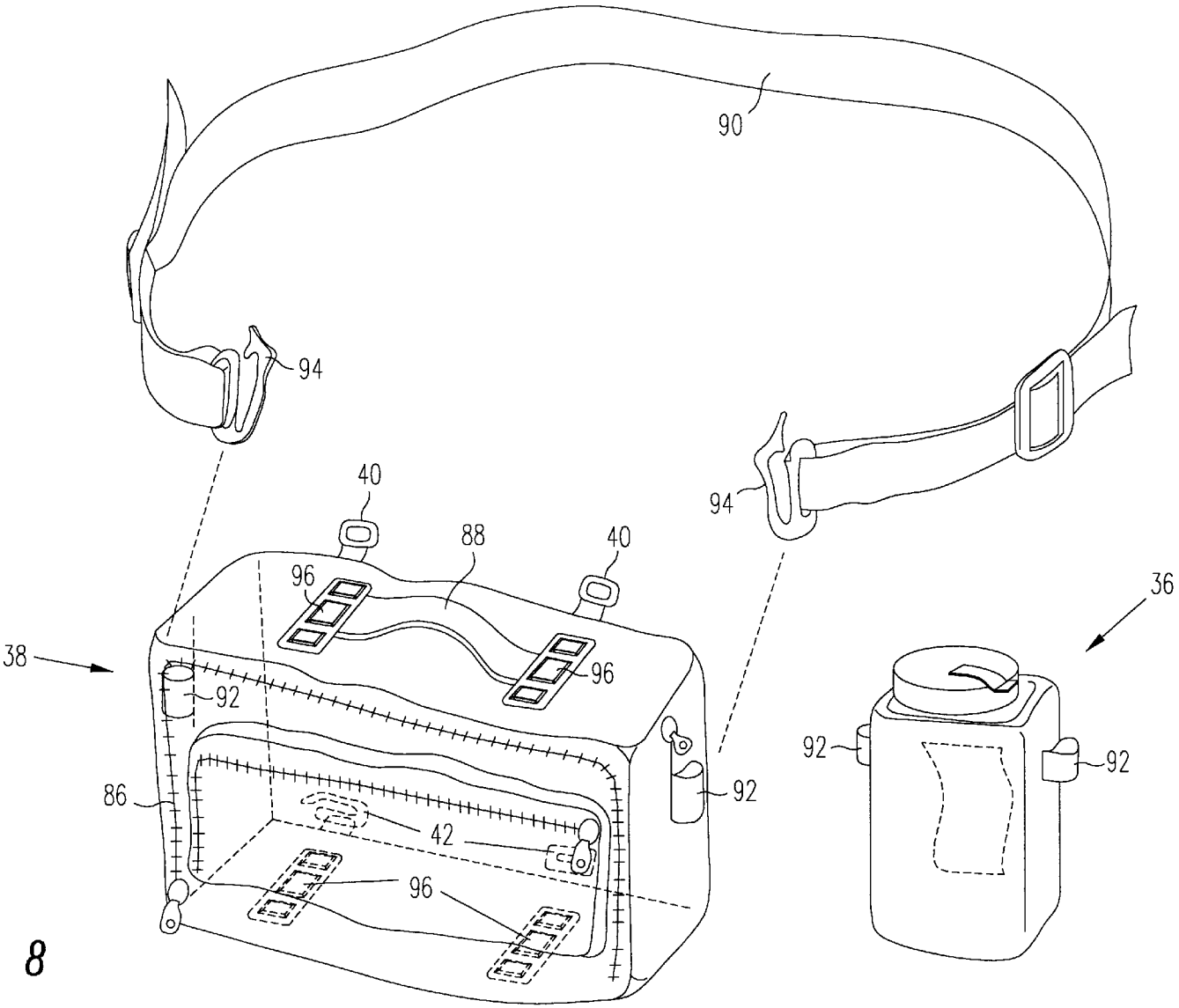
FIG. 8 is an exploded perspective view showing a pack bag, shoulder belt, and water bottle.

Referring to FIG. 8, a detailed view of pack bag 38 is shown. In the preferred embodiment, pack bag 38 includes a main compartment and a side compartment each closed by conventional zippers 86. Bag 38 is provided with a handle 88 on top for carrying bag 38 by hand when it is removed from the pack harness. A removable shoulder strap 90 may he attached to bag 38 to carry just bag 38 over one shoulder. Strap 90 is connected to loops 92 on opposite sides of bag 38 using releasible clips 94, or other suitable connection device such as clips with swivels. Strap 90 can also be used with water bottle carrier 36 in a similar manner.

Pack bag 38 is connected to back pack 10" (as shown in FIGS. 3 and 7A) by two plastic fittings 40 and two releasible clips 42. Plastic fittings 40 are slid into attachment loops 26 and then rotated so they anchor in place, as shown in FIG. 6B. Each clip 42 fastens around webbing 60 at the base of an attachment loop 26. In this way, bag 38 is attached to pack 10" at four points. Bag 38 can alternately be used with pack 10", separately with shoulder strap 90, or carried by handle 88.

Pack bag 38 is also provided with laterally spaced tie down pads 96, two on the top and two on the bottom. Tie down pads 96 can be used in conjunction with attachment straps 28 to attach additional gear to bag 38, or further secure the gear that is attached to shoulder straps 20 and 22. Preferably, compression straps (shown in FIG. 3) are also provided across the outside of bag 38 over the side compartment to attach additional items if desired and hold internal contents in place.

Figure 9:
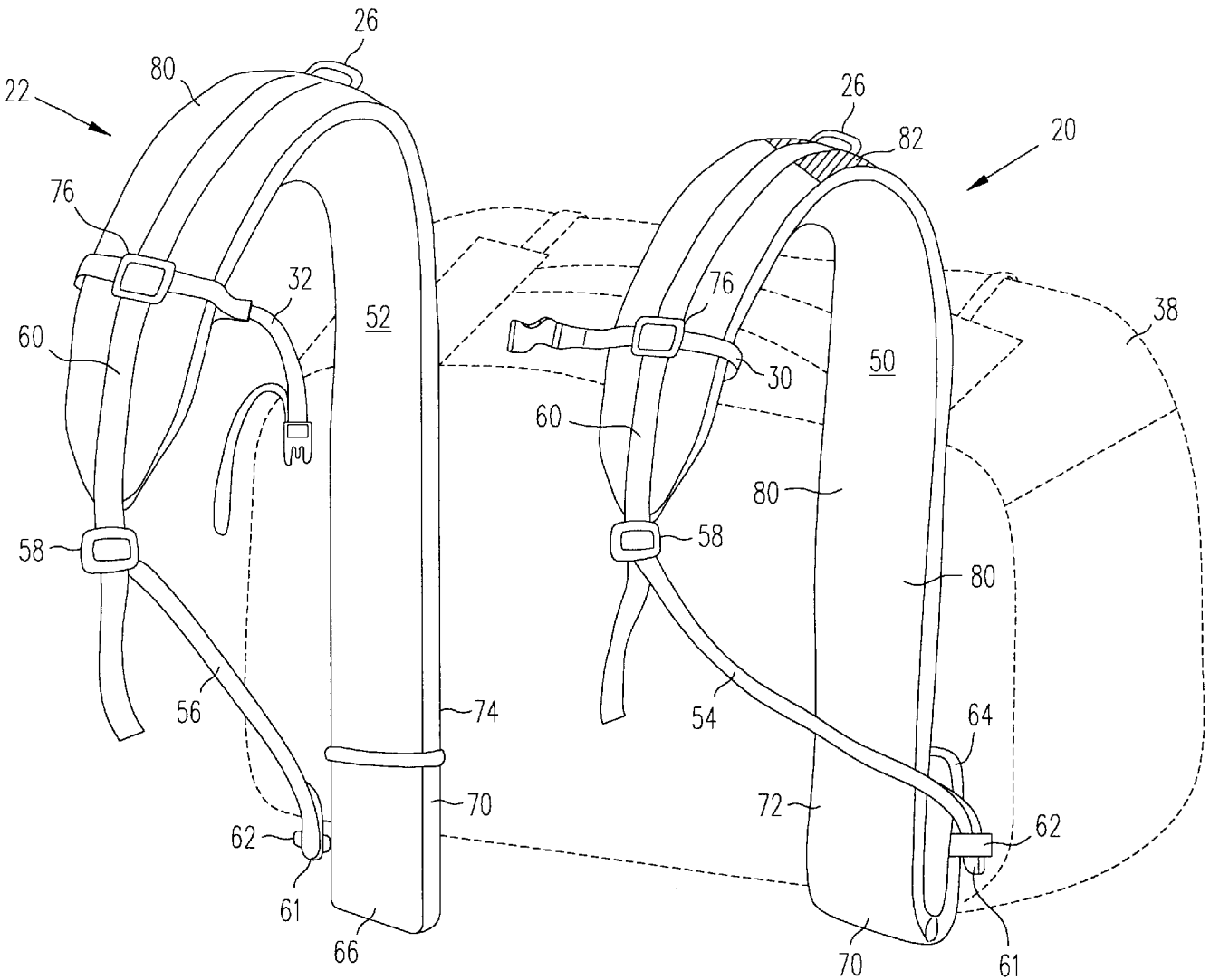
FIG. 9 is a front perspective view showing a configuration with shoulder straps, pack bag, and no waist belt.

Referring to FIG. 9, another configuration of the inventive harness system is shown. Shoulder straps 20 and 22 may be used what pack bag 38 and without a waist belt, much like a traditional book bag. For illustration purpose, only, left shoulder strap 20 is shown with its lower end 64 folded up and secured against adjacent portion 72 for use by a smaller child, while the right shoulder strap 22 is shown with its lower end 66 in the extended position for a larger child.

Pack bag 38 provides lateral stability to shoulder straps 20 and 22 when connected therewith. Because bag 38 is removable and reconnectable in a plurality of locations as described above, bag 38 can always be located in an optimal position, even after the child has grown. For example, after lower ends 64 and 66 are extended, bag 38 can be placed in a lower position to keep the weight of the pack as low as possible.

When no waist belt is used, loops 61 at the bottom of connecting straps 54 and 56 are anchored to the lower ends 64 and 66 of padded portions 50 and 52 solely by loops 62.

The above descriptions and drawings are for illustrative purposes only. It is to be understood that the present invention is not limited to the sole embodiments described above and illustrated herein, but encompasses any and all variations falling within the scope of the appended claims.

What is claimed as the invention is:

1. A frameless knapsack harness for a child comprising:

a waist belt for encircling a child's waist;

two shoulder straps each having a distal end, a proximal end portion, and a middle portion therebetween, the distal end being connected to the proximal end portion such that each shoulder strap forms a circular loop for loosely encircling one of a child's shoulders;

two waist belt loops, the loops respectively located on the proximal end portion of each of the shoulder straps for slidably receiving the waist belt to adjustably attach the shoulder strap to the waist belt at a rearward position thereof; and two hinge portions, each hinge portion located across one of the shoulder straps between the proximal end portion and an adjacent intermediate portion, the hinge portion permitting the proximal end portion to be folded up and secured against the adjacent intermediate portion in a retracted position such that the waist belt and waist belt loop reside higher on the shoulder strap than when not in the retracted position, thereby allowing a single knapsack harness to properly fit a smaller child with the proximal end portion in the retracted position and continue to properly fit when the child grows and the proximal end portion is extended into a non-retracted position.

2. A frameless knapsack harness according to claim 1 wherein the proximal end portions and the adjacent intermediate portions of the shoulder straps are padded.

3. A frameless knapsack harness according to claim 1 wherein each of the two shoulder straps further comprises a main strap and a connecting strap adjustably connected end to end, the main strap having the proximal end portion, the waist band loop, the hinge portion, the adjacent intermediate portion, and the middle portion, the connecting strap having the distal end, the main strap being padded along substantially its entire length.

4. A frameless knapsack harness according to claim 1 further comprising a third and fourth waist belt loop respectively located on the distal end of each shoulder strap for receiving the waist belt therethrough.

5. A frameless knapsack harness according to claim 1 wherein the proximal end portion of each shoulder strap has the waist band loop facing away from the child and a predetermined amount of padding between the waist band loop and the child when the proximal end portion is in the non-retracted position.

6. A frameless knapsack harness according to claim 5 wherein the proximal end portion of each shoulder strap has the waist band loop facing the child and the same predetermined amount of padding between the waist band loop and the child when the proximal end portion is in the retracted position.

7. A frameless knapsack harness according to claim 1 wherein the proximal end portion of each shoulder strap folds outward and upward against the adjacent intermediate portion.

8. A frameless knapsack harness according to claim 1 further comprising a plurality of attachment fittings located along the shoulder straps for attaching gear onto the harness such that the gear releasably spans between the two shoulder straps.

9. A frameless knapsack harness for a child comprising:

a waist belt for encircling a child's waist;

two shoulder straps each having a distal end, a proximal end portion, and a middle portion therebetween, the distal end being connected to the proximal end portion such that each shoulder strap forms a circular loop for loosely encircling one of a child's shoulders;

two waist belt loops, the loops respectively located on the proximal end portion of each of the shoulder straps for slidably receiving the waist belt to adjustably attach the shoulder strap to the waist belt at a rearward position thereof;

a plurality of attachment fittings located along an outer rear portion of each of the shoulder straps for attaching gear onto the harness such that the gear releasably spans between the two shoulder straps with nothing permanently spanning therebetween and such that any rigidity that the knapsack harness has is provided by the attached gear, thereby providing a lightweight knapsack and allowing the amount of gear attached to the harness to increase as the child grows.

10. A frameless knapsack harness according to claim 9, wherein the plurality of attachment fittings are oblong plastic rings for receiving straps to secure the gear.

11. A frameless knapsack harness according to claim 9, further comprising a bag for spanning between the two shoulder straps and removably attaching to four of the attachment fittings.

12. A frameless knapsack harness according to claim 11, wherein the bag includes a removable carrying strap for use when the bag is removed from the harness.

13. A knapsack for a child comprising:

two shoulder straps each having a distal end, a proximal end portion, and a middle portion therebetween, the distal end being connected to the proximal end portion such that each shoulder strap forms a circular loop for loosely encircling one of a child's shoulders;

a pack bag removably attached to and spanning between the middle portions of the shoulder straps; and two hinge portions, the hinge portions respectively located across each of the shoulder straps between the proximal end portion and an adjacent intermediate portion, the hinge portion permitting the proximal end portion to be folded up and secured against the adjacent intermediate portion in a retracted position to shorten each shoulder strap, thereby allowing a single knapsack harness to properly fit a smaller child with the proximal end portion in the retracted position and continue to properly fit when the child grows and the proximal end portion is extended into a non-retracted position.

14. A knapsack according to claim 13 further comprising a plurality of attachment fittings longitudinally spaced along the middle portions of the shoulder straps for removably attaching the pack bag, the plurality of attachment fittings allowing the pack bag to be alternately attached to the shoulders straps in a plurality of positions.

* * * * *